US010596411B2

(12) United States Patent
Callanan

(10) Patent No.: US 10,596,411 B2
(45) Date of Patent: Mar. 24, 2020

(54) PERSONAL EXERCISER/ACCESSORY

(71) Applicant: Corfit Inc., Stoughton, MA (US)

(72) Inventor: Keith Callanan, Stoughton, MA (US)

( * ) Notice: Subject to any disclaimer, the term of this patent is extended or adjusted under 35 U.S.C. 154(b) by 154 days.

(21) Appl. No.: 15/926,083

(22) Filed: Mar. 20, 2018

(65) Prior Publication Data

US 2018/0280757 A1 Oct. 4, 2018

Related U.S. Application Data

(60) Provisional application No. 62/477,787, filed on Mar. 28, 2017.

(51) Int. Cl.

| | |
|---|---|
| ***A63B 22/20*** | (2006.01) |
| ***A63B 21/055*** | (2006.01) |
| ***A63B 22/14*** | (2006.01) |
| ***A63B 21/04*** | (2006.01) |
| *A63B 21/00* | (2006.01) |
| *A63B 26/00* | (2006.01) |
| *A63B 23/04* | (2006.01) |
| *A63B 23/12* | (2006.01) |
| *A63B 23/02* | (2006.01) |

(52) U.S. Cl.

CPC ..... *A63B 22/20* (2013.01); *A63B 21/0428* (2013.01); *A63B 21/0552* (2013.01); *A63B 22/14* (2013.01); *A63B 21/0004* (2013.01); *A63B 21/0435* (2013.01); *A63B 21/0557* (2013.01); *A63B 23/0216* (2013.01); *A63B 23/0488* (2013.01); *A63B 23/1236* (2013.01); *A63B 26/003* (2013.01)

(58) Field of Classification Search

CPC ..... A63B 22/203; A63B 22/20; A63B 22/16; A63B 21/0552

See application file for complete search history.

(56) References Cited

U.S. PATENT DOCUMENTS

| | | | | |
|---|---|---|---|---|
| 4,892,305 | A * | 1/1990 | Lynch | A63B 22/20 482/132 |
| 6,740,008 | B1 * | 5/2004 | Ho | A63B 21/0004 482/123 |
| 6,945,919 | B2 * | 9/2005 | Yang | A63B 5/11 482/141 |
| 8,016,732 | B2 * | 9/2011 | Susnjara | A63B 21/0004 482/142 |
| 8,632,440 | B2 * | 1/2014 | Pratson | A63B 21/0552 273/458 |
| 9,079,072 | B2 * | 7/2015 | Agostini | A63B 22/18 |
| 9,095,738 | B2 * | 8/2015 | Senegal | A63B 22/18 |
| 9,149,676 | B2 | 10/2015 | Callanan | |
| 9,623,273 | B1 * | 4/2017 | Chen | A63B 21/0004 |
| 9,750,980 | B1 * | 9/2017 | Khalili | A63B 26/003 |

(Continued)

FOREIGN PATENT DOCUMENTS

WO WO-2016026047 A1 * 2/2016 ..... A63B 22/20

*Primary Examiner* — Michael C McCullough

(74) *Attorney, Agent, or Firm* — Frank Marino

(57) ABSTRACT

An exerciser has a baseplate with a fulcrum projecting outwardly from one side and wheels depending outwardly from the opposite side. A balanced-enhanced exercising platform is provided when the fulcrum is positioned downwardly on a floor, and alternatively, a balance-enhanced exercising dolly is provided when the wheels are positioned downwardly on the floor. The dolly may be biased by elastic resistance straps.

18 Claims, 8 Drawing Sheets

(56) References Cited

U.S. PATENT DOCUMENTS

| | | | | |
|---|---|---|---|---|
| 9,833,659 | B1 * | 12/2017 | Nicholas | A63B 21/0004 |
| 10,220,243 | B2 * | 3/2019 | Koegel | A63B 21/4035 |
| 2007/0298947 | A1 * | 12/2007 | Eksteen | A63B 21/0004<br>482/141 |
| 2009/0305853 | A1 * | 12/2009 | Jordan | A63B 21/0004<br>482/132 |
| 2017/0021218 | A1 * | 1/2017 | Peritz | A63B 21/4035 |

* cited by examiner

PERSONAL EXERCISER/ACCESSORY

RELATED APPLICATIONS

This application claims all entitled Priority to U.S. Provisional Application No. 62/477,787 filed on 28 Mar. 2017, the entire teachings of which are incorporated herein by reference.

FIELD OF INVENTION

The present invention relates generally to personal exercise or workout devices. More specifically the present invention relates to exercise devices, or to accessories for exercise devices, that can be used in many different positions and ways to strengthen, tone, and improve the flexibility of the user, by changing the dynamics of resistance and creating instability, which in turn causes the user's muscles to inherently attempt to stabilize to a greater extent than by traditional workouts.

BACKGROUND

U.S. Pat. No. 9,149,676 ('676) discloses an exercise device which may be used in many different positions and ways to strengthen the human body by changing the dynamics of resistance, creating instability which in turn causes the muscles to inherently attempt to stabilize to a greater extent than typical workouts. As useful and versatile as this device has proven to be, it has been found that certain muscles and joints cannot be effectively treated by the exercises enabled thereby, or by any other means yet available. Proprioceptors are sensory receptors that receive stimuli from within the body, especially stimuli that respond to position and movement. Proprioceptors are engaged when the muscles unconsciously react to overcome imbalance and instability. Engaging proprioceptors is beneficial in that it helps fight the deficit of lost balance when during the aging process. Proprioception is lost during an injury, and will need to be restored post injury by continually activating and challenging. Existing exercisers are lacking in their ability to effectively engage proprioceptors.

There is a need for means to enable the effective treatment of additional muscles and joints not treatable by the device of '676 or the remaining prior art, and such means are therefore an object of the present invention.

There is a need for exercises to effectively treat muscles and joints not treatable by the device of '676 or the remaining prior art, and such exercises along with providing means for enabling them are therefore objects of the present invention.

There is a need for means to enable the effective engagement of proprioceptors and such means are therefore an object of the present invention.

There is a need for exercises to effectively treat muscles and joints through the engagement of proprioceptors, and such exercises along with providing means for enabling them are therefore objects of the present invention.

There is a need for means to expand the versatility of the device of '676, and such means are therefore an object of the present invention.

Additional needs and objects addressed by the present invention will become obvious in view of the disclosure herein.

SUMMARY OF THE INVENTION

The present invention may be an accessory to the device disclosed in '676, or similar exercising devices, to enable effective engagement of proprioceptors and treatment of muscles and joints not treatable or less effectively treatable therewith or otherwise. The present invention may be a stand-alone exerciser for enabling effective engagement of proprioceptors and treatment of muscles and joints not treatable or less effectively treatable by the device of '676, or similar exercisers, therewith or otherwise. The present invention may or may not include the features of the device disclosed in '676, or similar exercisers, along with additional features for enabling effective engagement of proprioceptors and treatment of muscles and joints not treatable or less effectively treatable thereby. The present invention may lie within the exerciser/accessory for enabling these novel additional exercises, or may lie in the novel exercises enabled by the exerciser/accessory. For brevity, the disclosure of '676 is not repeated herein, but is being referred to herein and is incorporated herein by reference, in its entirety.

An exemplary exerciser/accessory is disclosed herein in accordance with or useful in practicing the invention, which may be used alone or with an exerciser of the type or similar to the type disclosed in '676. The exerciser/accessory may be removably affixable to the ring (item 10 of '676) of the main device and may be there-through removably connectable to its resistance straps (items 30 and 31 of '676), or elements similar thereto.

The disclosed exerciser/accessory may include a baseplate with a removable downwardly depending fulcrum on its underside to form an unstable platform for use independently to enable balance-enhanced floor exercises. The base plate may have one or more wheels on its opposite side and may alternatively be used independently with the one or more wheels depending downwardly, creating a dolly to enable translational floor exercises. Or the dolly may be an accessory removably affixed to the ring (item 10 of '676) of the main device to enable biased translational floor exercises. Accordingly, the device may be convertible between an independent exercising device and an accessory for another exercising device.

The invention may be exemplified by or practiced using an exerciser/accessory having a baseplate with first and second planar sides and a peripheral edge. The first planar side may have a fulcrum disposed centrally thereon and projecting outwardly normally therefrom. The second planar side may be parallel to the first planar side and may have one or more wheels depending outwardly therefrom, and a foot-receiving surface on and coplanar therewith, disposed symmetrically about the fulcrum. A balanced-enhanced exercising platform may be provided when the fulcrum is positioned downwardly on a floor, and alternatively, a balance-enhanced exercising dolly may be provided when the one or more wheels are positioned downwardly on the floor. The one or more wheels may be a plurality of wheels disposed on a centerline of the second side and enabled to roll along a linear pathway aligned with the centerline. A first connector may be disposed on the centerline. A planar ring may be removably securable to and coplanar with the first planar side to form a part thereof. The first connector may be disposed on a periphery of the planar ring.

The exerciser/accessory may have an elongate elastic strap removably affixable to the first connector at its proximal end. The exerciser/accessory may have a remote fixed-position connector, and the elongate elastic strap may be removably affixable to the remote fixed-position connector at its distal end. A biased and balance-enhanced exercising dolly may be provided when the one or more wheels are positioned downwardly on the floor and the strap is connected between the first connector and the remote fixed-position connector.

The exerciser/accessory may have a soft planar pad removably affixable to the first planar side and parallel thereto.

The planar ring may have a center bar there-across, perpendicular to the centerline of the second side and a pair of secondary bars there-across, parallel to and spaced symmetrically about the centerline of the second side. The center bar and secondary bars may provide handles for grasping during use as a balance-enhanced exercising dolly and may define recesses for foot placement during use as a balance-enhanced exercising dolly.

The remote fixed connecter may include a pair of coplanar, oppositely-directed, and outwardly-directed hooks, symmetrically disposed about a distally projecting longitudinal threaded portion.

The invention may also be exemplified by or practiced using an accessory for use with an exerciser of the type including a circular ring having a connector extending radially outwardly from an outer edge thereof, and an elongate elastic resistance strap configured to provide a resistance to movement when stretched lengthwise and removably attached to the connector at a proximal end and removably attached to a fixed position anchor at a distal end. The accessory may have a baseplate having first and second planar sides and a peripheral edge. The first planar side may be removably securable to and coplanar with the circular ring and may include a fulcrum disposed centrally thereon and projecting outwardly normally therefrom. And the second planar side may be parallel to the first planar side and may have one or more wheels depending outwardly therefrom, and a foot-receiving surface on and coplanar with the second side and disposed symmetrically about the fulcrum. A balanced-enhanced exercising platform may be provided when the fulcrum is positioned downwardly on a floor, and alternatively, a biased and balance-enhanced exercising dolly may be provided when the one or more wheels are positioned downwardly on the floor.

Further features and aspects of the invention are disclosed with more specificity in the detailed description and drawings provided herein.

DRAWINGS AND ILLUSTRATIONS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

An exemplary exerciser/accessory 100, both alone and with the exerciser of '676, including in use, is shown in the accompanying drawings and described as follows.

Figure 1:
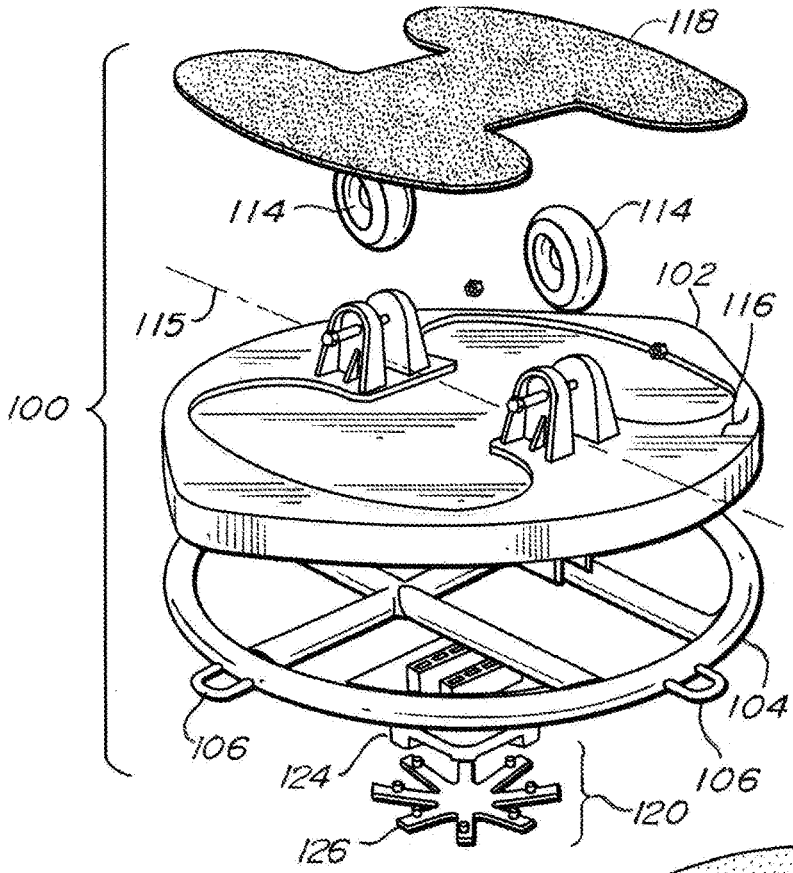
FIG. 1 is an exploded view of an exemplary exerciser/accessory, together with the ring of '676, in its balance platform orientation.

Referring to FIG. 1, baseplate 102 is affixable on its first side 122 to ring 104 (exemplified by ring 10 of '676). The baseplate is preferably made of molded plastic. The preferably metal ring may or may not be part of the exerciser/accessory, and as stated in '676, the ring may have a substantially circular or oval shape. Not stated therein but made obvious thereby, the ring may alternatively have any equivalent shape, including but not limited to square, rectangular, hexagonal, octagonal, etc. The baseplate is shown having the same substantially circular shape as the shown ring, but may have any other shape according to the selected shape of the ring.

Figure 5:
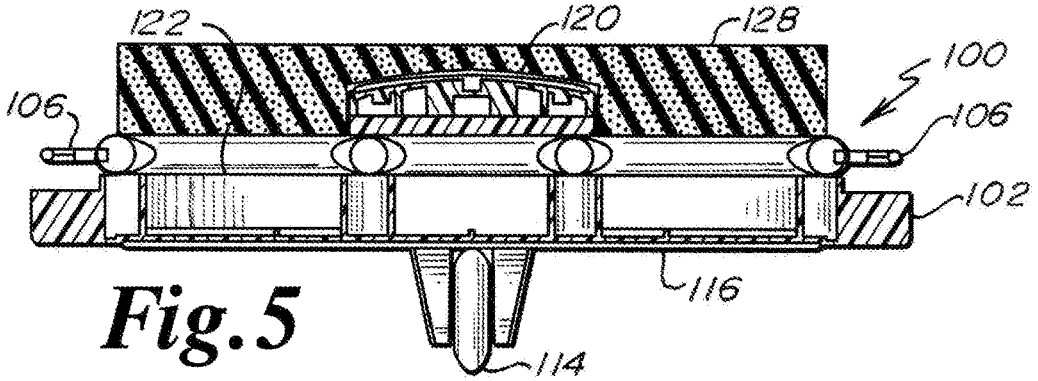
FIG. 5 is a cross-sectional side view of the exerciser/accessory of FIG. 1, together with the ring of '676, in its dolly orientation.

As stated in '676 and justified later herein, a plurality of strap connectors 106 extend radially outward around the ring from the periphery thereof. As in '676, a primary cross bar 108 and two secondary cross bars 110, cross the ring. As stated in '676 and justified later herein, the ring and cross-bars provide a plurality of available handles 112, which remain accessible when the ring and baseplate are joined as shown in FIG. 5.

Wheels 114 are rotationally secured to the baseplate and protrude from second side 116 thereof. While any plurality of wheels may alternatively be included, including a single centrally positioned wheel, it is preferred that the wheels are aligned on centerline 115 so they will/may travel on a linear path aligned with that centerline. The wheels could also be universally pivotable casters or spherical casters which may roll in any direction . . . as long as they are aligned along centerline 115. As will be later appreciated, this causes instability about that centerline which the user will consciously or subconsciously need to overcome while exercising. Friction pad 118, preferably adhesive-backed, is permanently adhered to the second side.

Figure 2:
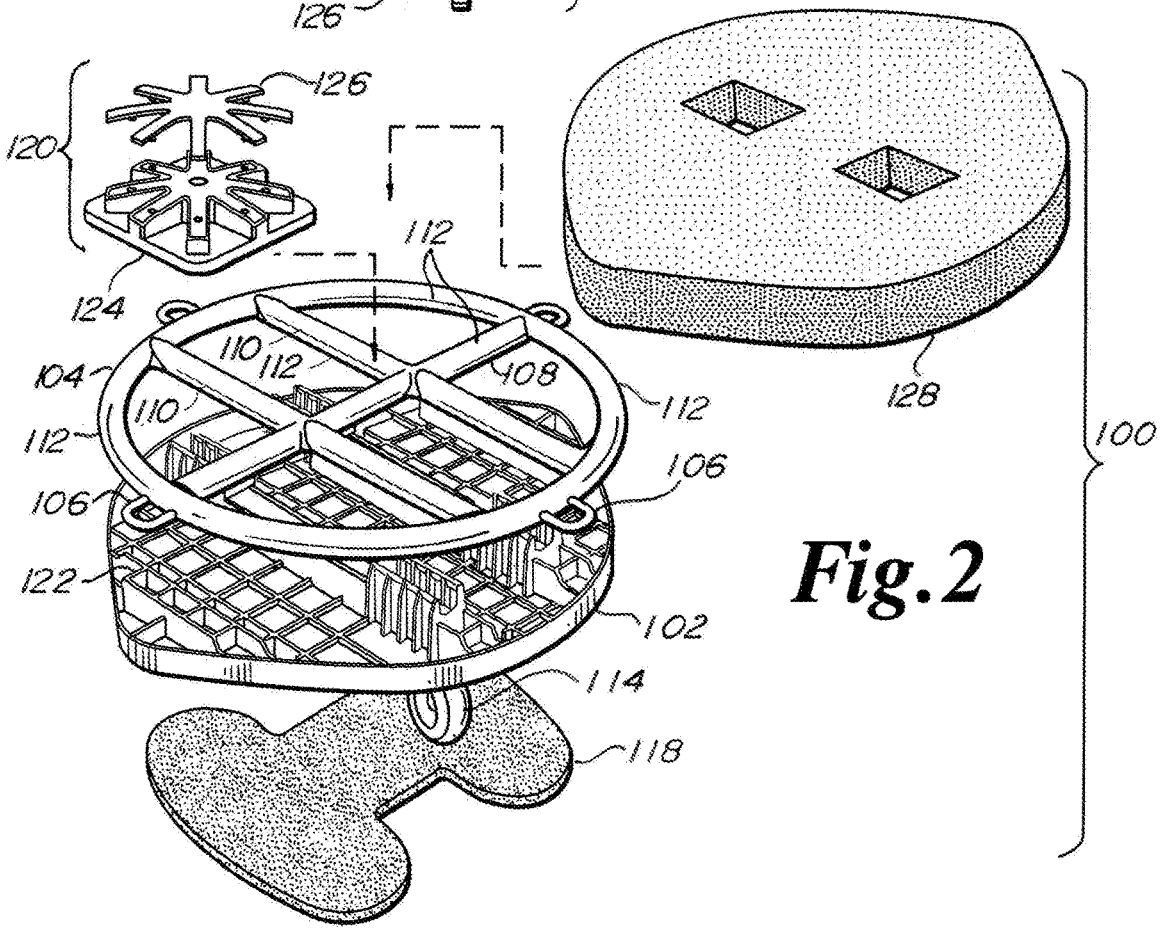
FIG. 2 is an exploded view of the exerciser/accessory of FIG. 1, together with the ring of '676, in its dolly orientation.

In FIG. 2 the assembly of FIG. 1 is seen from the opposite direction. It can be seen that fulcrum 120 affixes to the ring on baseplate's first. The fulcrum could alternatively affix directly to the first side. The fulcrum pad includes fulcrum block 124 and star-shaped pad 126. The block is preferably plastic, and the pad is preferably rubber or an equivalent.

Figure 3:
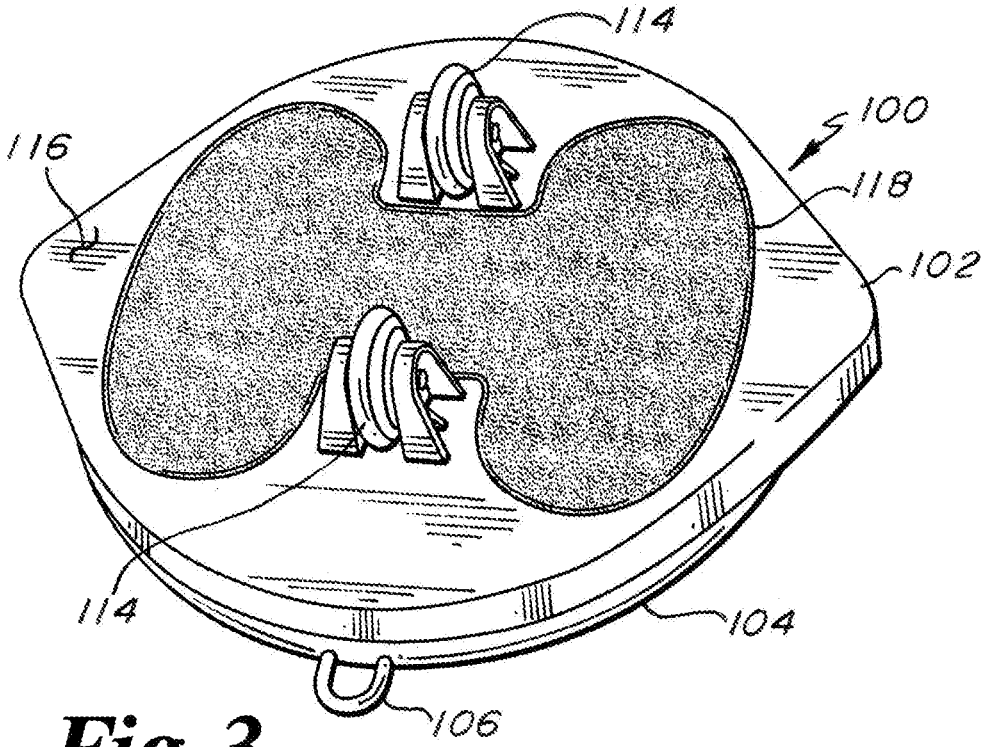
FIG. 3 is a perspective view of an exemplary exerciser/accessory of FIG. 1, together with the ring of '676, in its balance platform orientation.
Figure 6:
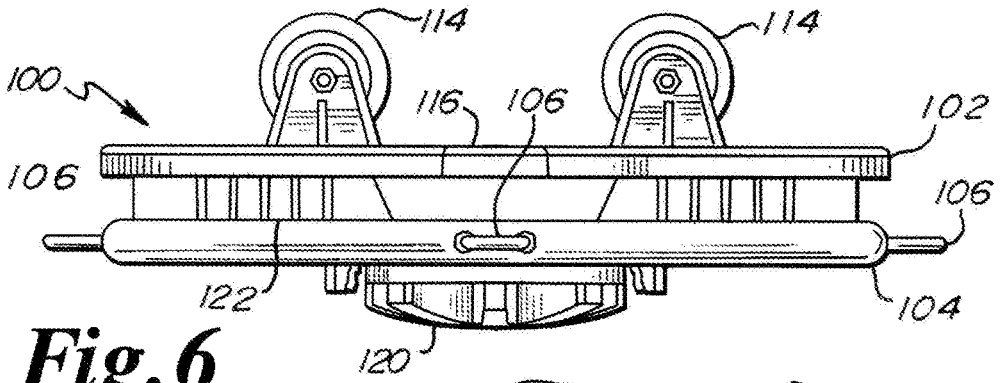
FIG. 6 is a side view of the exerciser/accessory of FIG. 1, together with the ring of '676, in its balance platform orientation.
Figure 7:
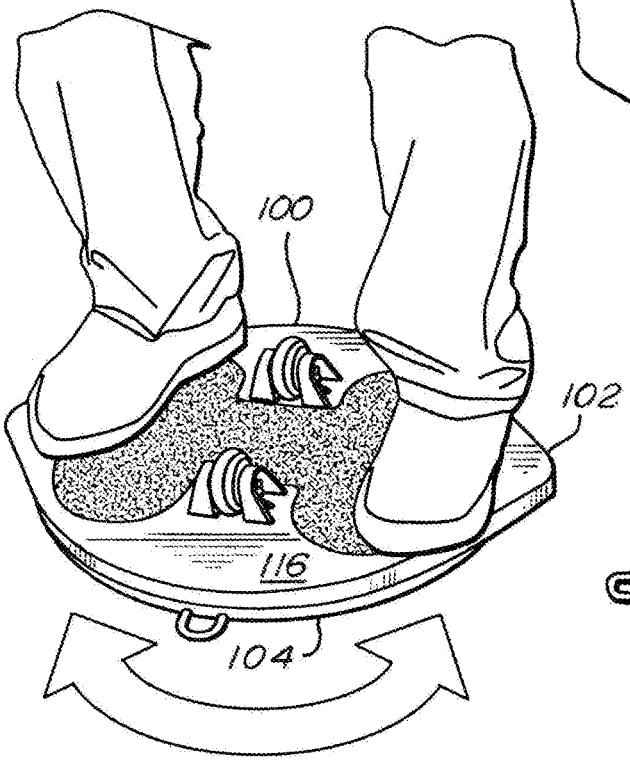
FIG. 7 is a perspective view of the exerciser/accessory of FIG. 1 during a two-foot balancing exercise while in its balance platform orientation.
Figure 8:
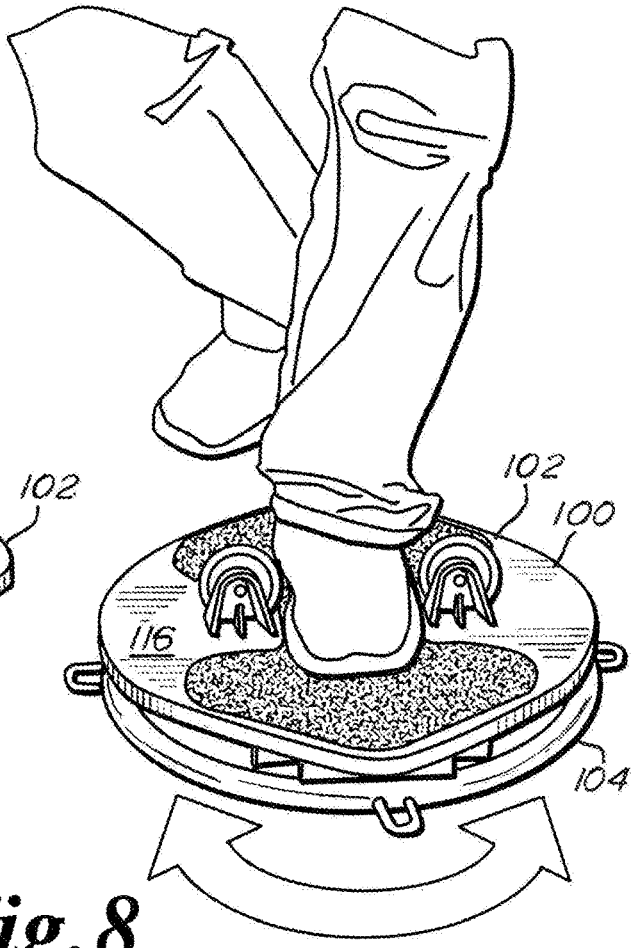
FIG. 8 is a perspective view of the exerciser/accessory of FIG. 1 during a one-foot balancing exercise while in its balance platform orientation.

The fulcrum is useful when the assembly is oriented as shown in FIGS. 1, 3, and 6, wherein the second surface of the baseplate serves as a platform and with the user standing on the friction pad he may perform balance-enhanced exercises, such as shown in FIGS. 7 and 8. Such balance-enhanced exercisers are especially useful for engaging proprioceptors, and may include common exercises which are enhanced by the balancing required as a result of the fulcrum, and the inherent efforts that the user's muscles make to overcome the resulting instability.

For instance, the exercise being performed above FIG. 7 might be an otherwise ordinary squat, and the exercise being performed above FIG. 8 might be an otherwise ordinary one-legged squat, but it is found that the performance of such exercises combined with the need to remain balanced over the fulcrum results in muscle activities that are not required during such exercises on a stable floor.

Figure 4:
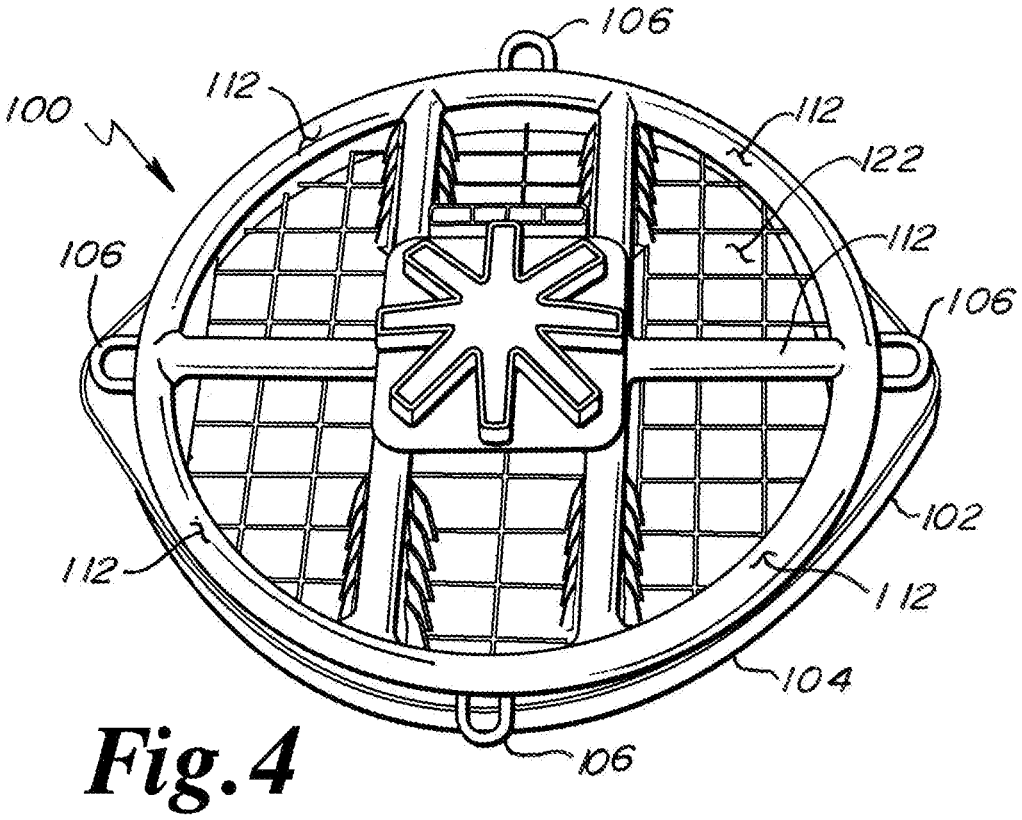
FIG. 4 is a perspective view of the exerciser/accessory of FIG. 1, together with the ring of '676, in its dolly orientation.
Figure 16:
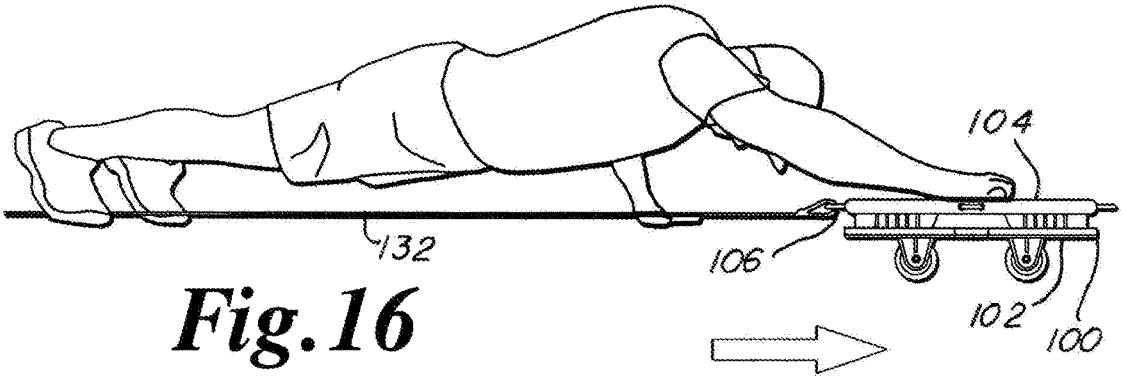
FIG. 16 is a side view of the exerciser/accessory of FIG. 1 during an eighth translational exercise while in its dolly orientation.
Figure 17A:
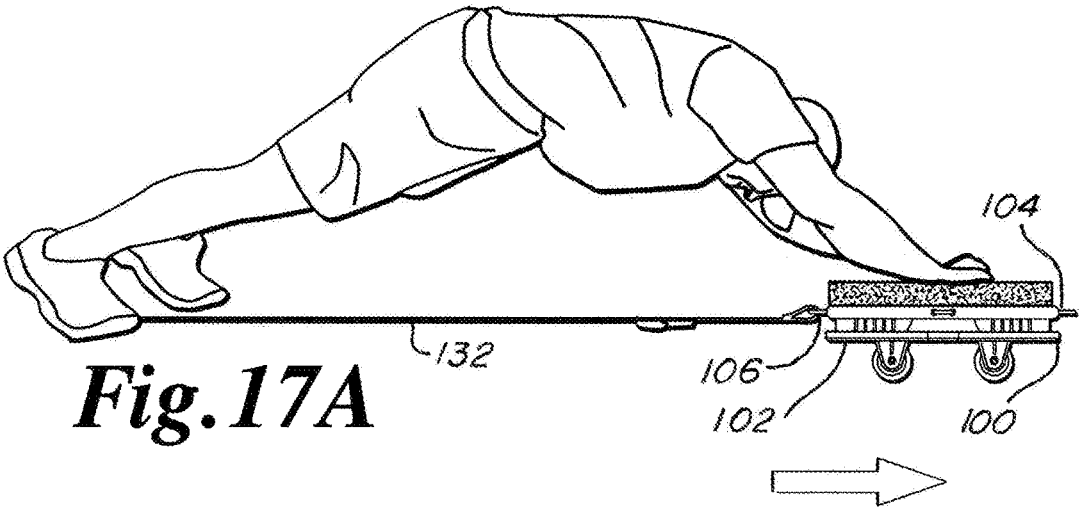
FIG. 17A is a side view of the exerciser/accessory of FIG. 1 during a ninth translational exercise while in its dolly orientation.
Figure 17B:
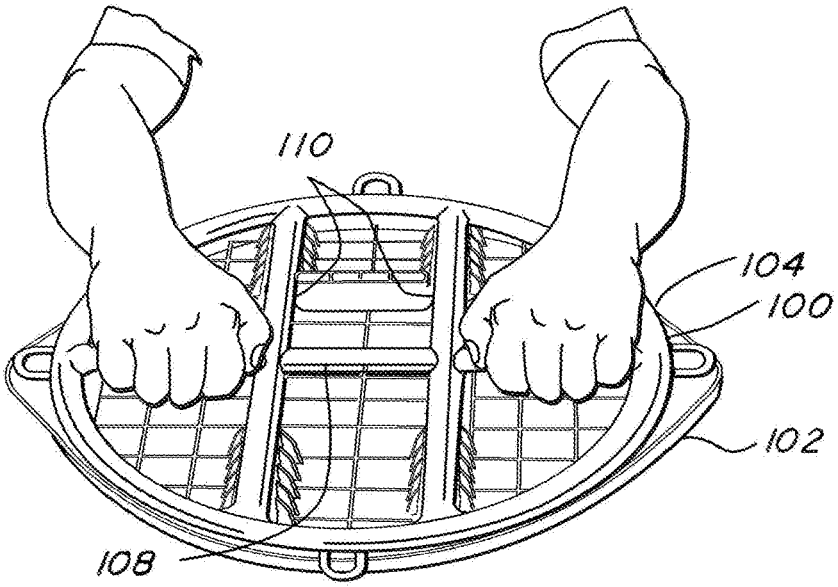
FIG. 17B is a perspective view of the exerciser/accessory of FIG. 1 during the exercise of FIG. 17A.
Figure 18:
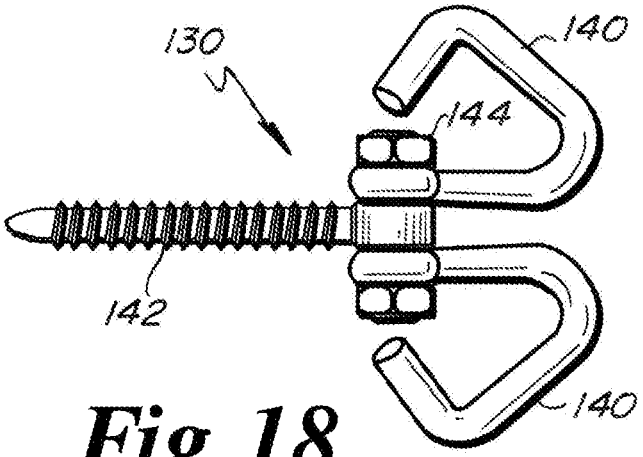
FIG. 18 is a view of a strap anchoring device for use with the exerciser/accessory of FIG. 1.
Figure 19:
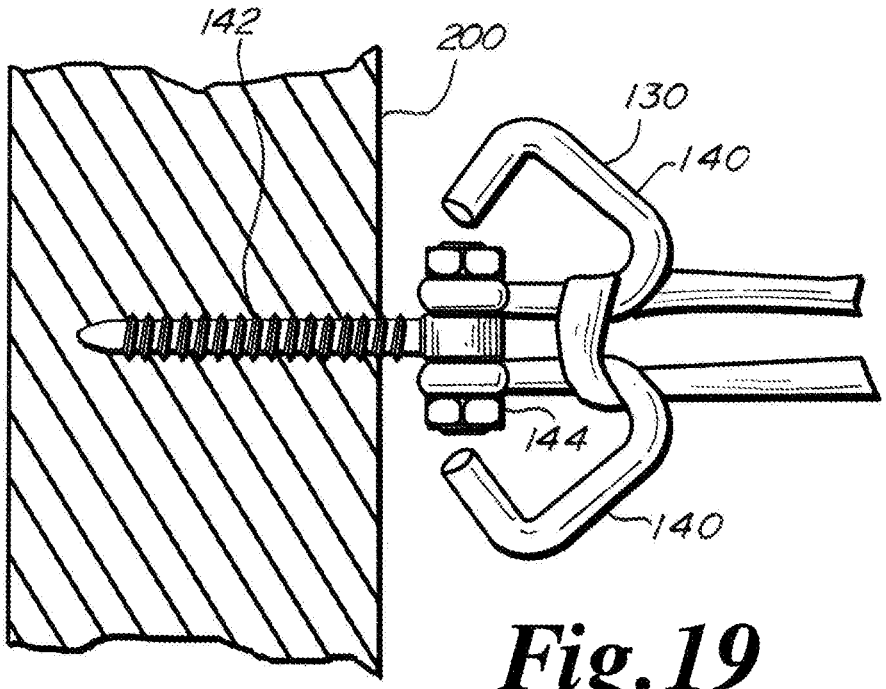
FIG. 19 is a side view of the strap anchoring device of FIG. 18 in use with a resistance strap.

The wheels are useful when the baseplate is turned over into the orientation shown in FIGS. 2, 4, and 5, wherein the first surface of the baseplate serves as a support for the user's hands, forearms, calves, or feet, allowing him/her to perform balance-enhanced and anti-biased translational exercises, such as shown in FIGS. 9A through 17B, especially when used with elastic resistance strap 132, anchored to a wall 200 by the novel hook 130 of FIGS. 18 and 19. Such balance-enhanced exercises are again especially useful for engaging proprioceptors.

Figure 12:
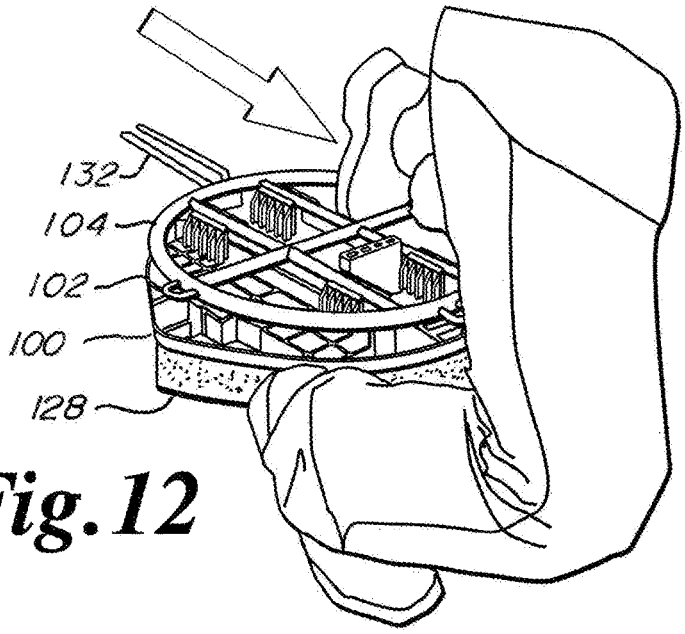
FIG. 12 is a perspective view of the exerciser/accessory of FIG. 1 during a fourth translational exercise while in its dolly orientation.
Figure 13:
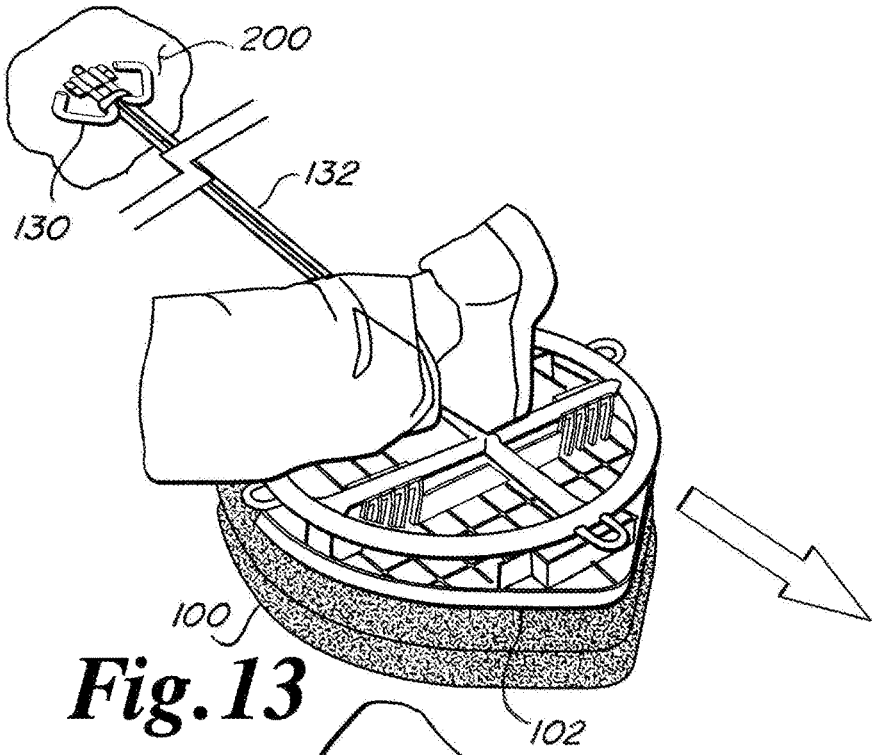
FIG. 13 is a perspective view of the exerciser/accessory of FIG. 1 during a fifth translational exercise while in its dolly orientation.

Soft foam-rubber pad 128 is shown having the same substantially circular outer shape as the baseplate but may have any other shape according to the selected shape of the ring. The foam-rubber pad is typically used when the device is used as in the FIG. 4 orientation doing exercises wherein the forearms or calves rest on the first side of the baseplate, to give comfort. It removably affixed to the first side of the baseplate by grasping the fulcrum. It may additionally be used to give comfort to the hands and feet during other exercises, although the first side of the baseplate and the ring provide handles and foot recesses (as shown in FIGS. 10B, 12, and 13) which the foam-rubber pad covers.

Additionally, the foam-rubber pad may be used against the second side of the baseplate when the device is used in the orientation of FIG. 4, with that side facing down, to provide additional stabilization during the translational exercises. For instance, it might initially be found that the transitional exercises are too difficult due to the side-to-side imbalance realized over the in-line wheels. But as the user gains strength over time, he/she may be able to remove the foam-rubber pad.

While many of the exercises of FIGS. 9A through 17B may be performed using the exerciser/accessory alone as a balance-enhanced dolly, the use of elastic resistance strap 132 (exemplified by straps 30 and 31 of '676) enhance the exercises by adding resistance and bias. The resistance strap is removably attached between connector 106 at the device and hook 132 at wall 200.

Figure 9A:
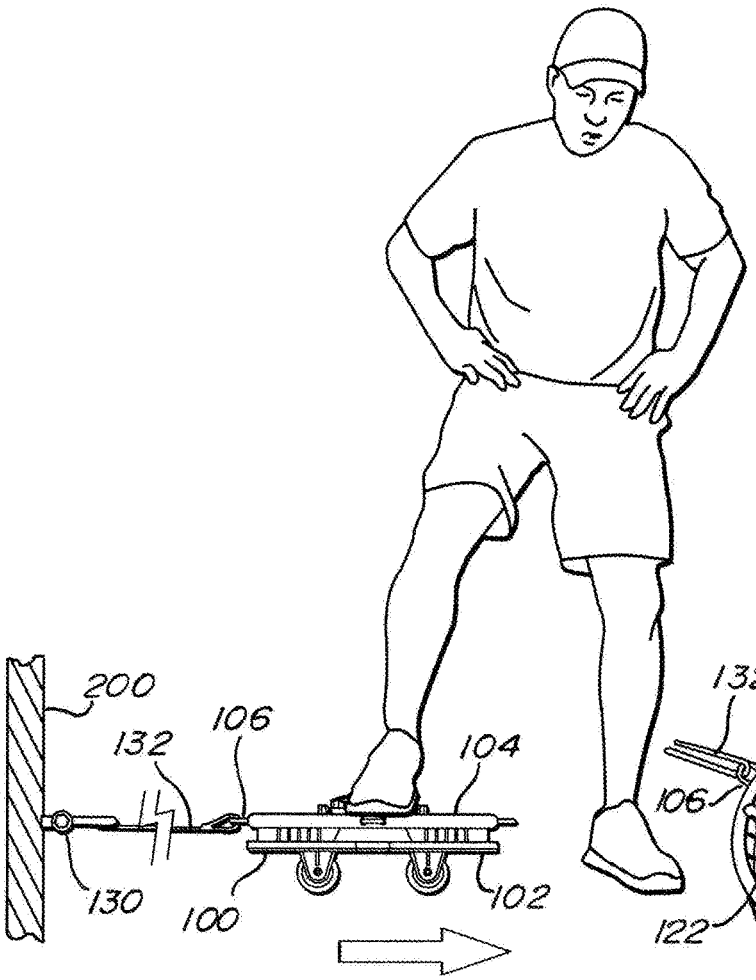
FIG. 9A is a side view of the exerciser/accessory of FIG. 1 during a translational exercise while in its dolly orientation.
Figure 9B:
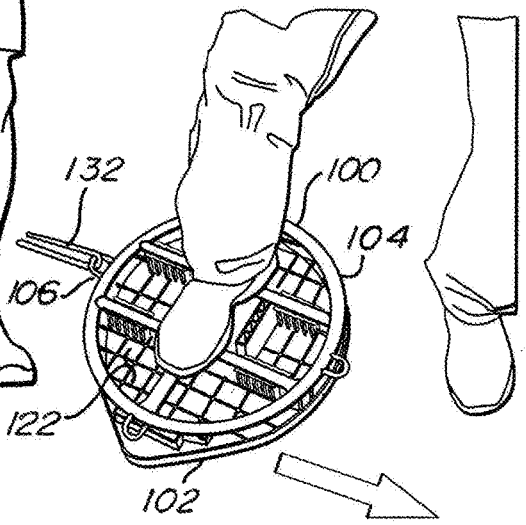
FIG. 9B is a perspective view of the exerciser/accessory of FIG. 1 during the exercise of FIG. 9A.

In FIGS. 9A and 9B, an exercise is performed where the user plants one foot on the floor and faces his opposite side towards the anchoring wall. He then places his other foot on first side 104 of the baseplate and repeatedly pulls the dolly towards his planted foot against the bias of the resistance strap, thereby working inner leg muscles. The imbalance of the device toward the toes and heel of the moving foot caused by the linear wheel alignment provides additional working of the muscles in the calf. They user then changes direction to work the other leg.

Figure 10A:
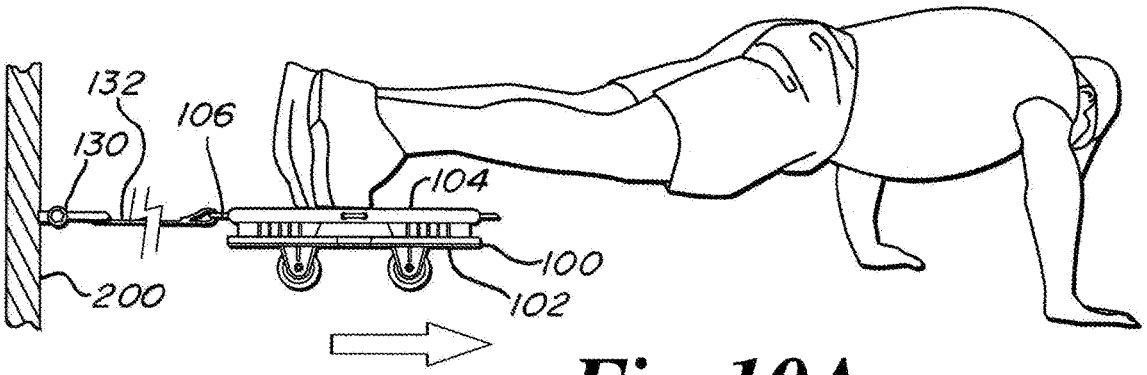
FIG. 10A is a side view of the exerciser/accessory of FIG. 1 during a second translational exercise while in its dolly orientation.
Figure 10B:
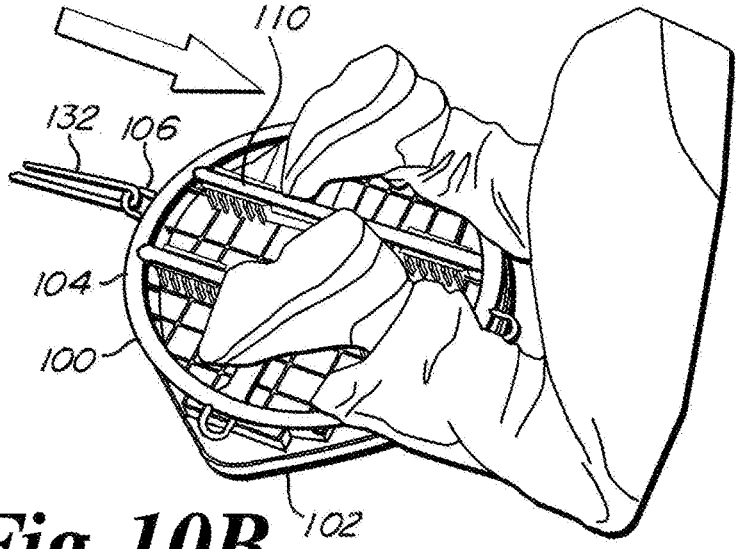
FIG. 10B is a perspective view of the exerciser/accessory of FIG. 1 during the exercise of FIG. 10A.
Figure 11:
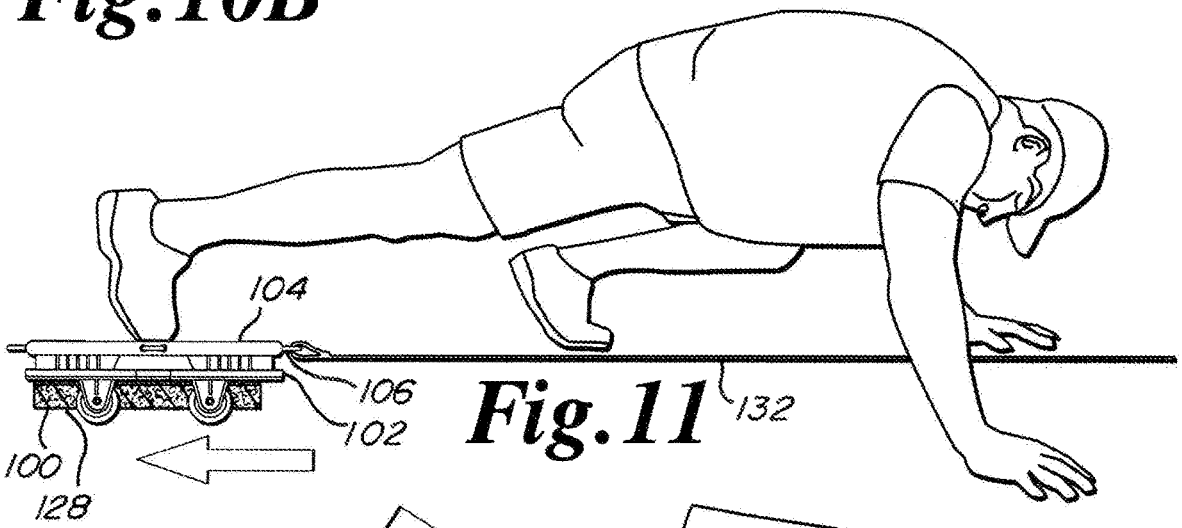
FIG. 11 is a side view of the exerciser/accessory of FIG. 1 during a third translational exercise while in its dolly orientation.

In FIGS. 10A and 10B, the user extends horizontally pointing away from the anchor wall and plants his hands on the floor and his feet into the recesses of ring 104 and against first side 122 of the baseplate. He then repeatedly pulls the dolly towards his planted hands against the bias of the resistance strap, thereby working the leg and abdominal muscles. The imbalance of the device between the left foot and right foot caused by the linear wheel alignment caused torque about the hips and spine which works additional muscles through the body. In FIG. 11 (best performed with the foam-rubber pad installed against the underside to the baseplate, the same exercise is performed using only one other leg and foot. The user then changes feet to work the other leg.

FIG. 13 shows an exercise wherein the user extends horizontally as in FIGS. 10A and 10B, except parallel with the anchor wall, places one foot into the device and plants the other, then moves the device towards or away from the planted foot, thereby working muscles on the outside and inside of the legs and on the sides of the abdomen. The planted foot may be the foot closest to the wall with the other foot pushing the dolly away from the planted foot, or the planted foot may be the one away from the wall, with the other foot pulling the dolly towards the planted foot. Whichever of these exercises is chosen, the user then reverses his orientation and repeats.

Figure 14:
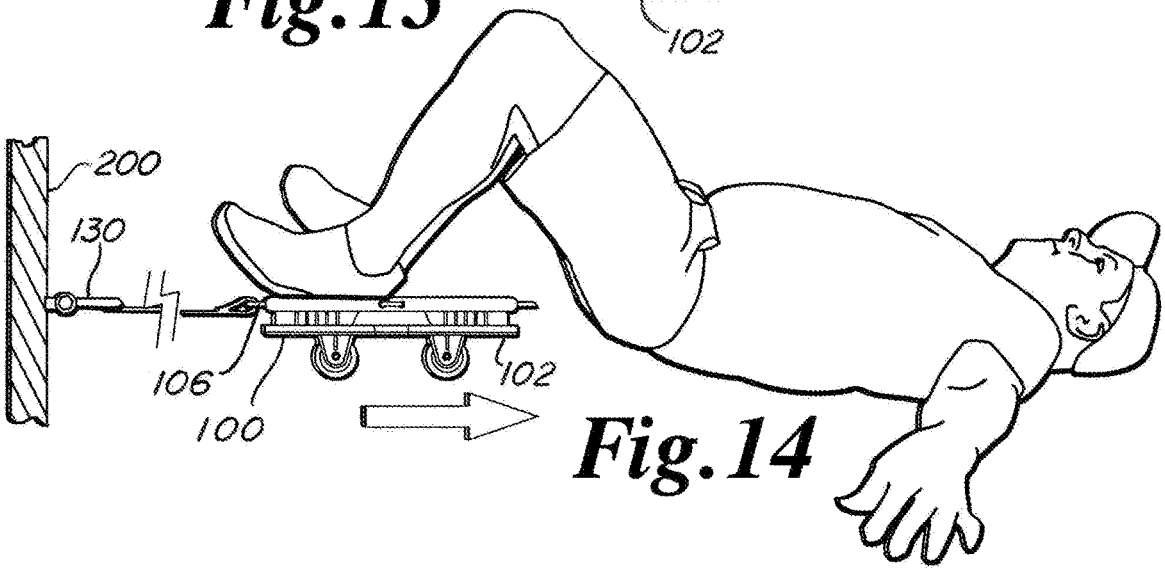
FIG. 14 is a side view of the exerciser/accessory of FIG. 1 during a sixth translational exercise while in its dolly orientation.

FIG. 14 demonstrates an exercise wherein the user lies on his back pointing away from the anchor wall and drops both heels down onto the dolly, then, while bending at the hips and knees, pulls the dolly towards his abdomen. Again, the imbalance caused by the aligned wheels causes an inherent and subconscious effort to stabilize, which works muscles not otherwise worked. This same exercise may be preformed using the feet one at a time, but is best done with the foam-rubber pad on the underside of the dolly.

Figure 15:
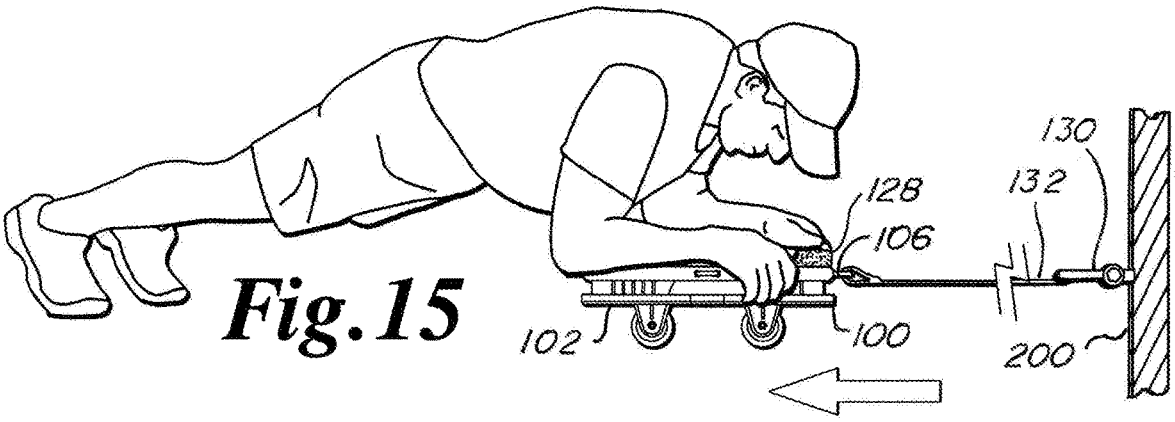
FIG. 15 is a side view of the exerciser/accessory of FIG. 1 during a seventh translational exercise while in its dolly orientation.

FIG. 15 demonstrates an exercise in which the user extends horizontally, pointing towards the anchor wall, with his toes planted and his forearms resting on the top of the dolly, preferably with the foam-rubber pad positioned atop the dolly to comfort the forearms. The user then pulls his abdomen towards his plated feet by bending at the hips and knees. This exercise can also be performed on one foot at a time, wherein the imbalance caused by the inline wheel alignment results in extreme torquing of the abdomen.

In FIG. 16 the user is extended horizontally and pointing away from the anchor wall with his toes and one hand planted on the floor. The other hand repeatedly pushes the dolly away from the wall. Then the hands are switched and the exercise is repeated. The hand grasping the dolly does so centrally to enhance the ability to stabilize the dolly.

FIGS. 17A and 17B show a similar exercise to FIG. 16*m* except using both hands FIGS. 18 and 19 depict the unique hooking arrangement for securing the distal end of the elastic resistance strap to the wall. Aside from its benefits during use on in the horizontal position shown in the exercises of FIGS. 9A to 17B, hook 130 also improves use of the device of the '676 patent during affixation of the strap higher up the wall. The double-hook arrangement prevents dangerous disconnection of the strap when pulled in directions not normal to the wall. When used in the exercises of FIGS. 9A to 17B, it is preferable to align the double-hook portion parallel to the floor (making FIGS. 18 and 19 top views), because those non-normal directions would most often all be parallel with the floor. But when the hook is mounted up the wall and or used to do those ring/strap exercises described in '676, the hook is better aligned vertically (making FIGS. 18 and 19 side views), to maintain its attachment to the strap even when tension on the strap aims downwardly or upwardly.

The hooking arrangement includes first and second oppositely-directed and outwardly directed hook portions 140, and distally-projecting longitudinal treaded portion 142. The hook portions are shown connected together with the threaded portion by a bolt/nut 144, but may alternatively be welded together or formed integrally together. And while the threaded portion is shown with coarse threading for securing to such materials as wood, it may alternatively have fine (machine) threading for securing into a tapped hole or securement by a nut.

And of course, this novel hooking arrangement may be useful in an infinite variety of applications besides in conjunction with the described exerciser/accessory.

While the exemplary embodiments described and illustrated herein provide some of the advantages and options of the invention, it should be understood that those are not meant to be limiting, and that the invention should only be limited by the following claims, including all deserved equivalent interpretation.

I claim:

1. An exerciser/accessory comprising:

a baseplate having first and second planar sides and a peripheral edge;

the first planar side including a fulcrum disposed centrally thereon and projecting outwardly normally therefrom, and the second planar side being parallel to the first planar side and comprising one or more wheels depending outwardly therefrom;

wherein all of the one or more wheels are colinearly-disposed on a centerline of the second side in order to roll along a single linear pathway aligned with the centerline; and a foot-receiving surface on and coplanar with the second side, disposed symmetrically about the fulcrum.

2. The exerciser/accessory of claim 1, wherein a balanced-enhanced exercising platform is provided when the fulcrum is positioned downwardly on a floor, and alternatively, a balance-enhanced exercising dolly is provided when the one or more wheels are positioned downwardly on the floor.

3. The exerciser/accessory of claim 2, further comprising a first connector disposed on the centerline.

4. The exerciser/accessory of claim 3, further comprising a planar ring removably securable to and coplanar with the first planar side to form a part thereof.

5. The exerciser/accessory of claim 4, wherein the first connector is disposed on a periphery of the planar ring.

6. The exerciser/accessory of claim 5, further comprising an elongate elastic strap having a proximal end and a distal end and being removably affixable to the first connector at the proximal end.

7. The exerciser/accessory of claim 6, further comprising a remote fixed-position connector attachable to a stationary surface, and wherein the elongate elastic strap is removably affixable to the stationary surface by the remote fixed-position connector at the distal end.

8. The exerciser/accessory of claim 7, wherein a biased and balance-enhanced exercising dolly is provided when the one or more wheels are positioned downwardly on the floor and the strap is connected between the first connector and the remote fixed-position connector.

9. The exerciser/accessory of claim 8, further comprising a soft planar pad removably affixable to the first planar side and parallel thereto.

10. An exerciser/accessory comprising:

a baseplate having first and second planar sides and a peripheral edge:

the first planar side including a fulcrum disposed centrally thereon and projecting outwardly normally therefrom, and the second planar side being parallel to the first planar side and comprising one or more wheels depending outwardly therefrom; and a foot-receiving surface on and coplanar with the second side, disposed symmetrically about the fulcrum;

wherein a balanced-enhanced exercising platform is provided when the fulcrum is positioned downwardly on a floor, and alternatively, a balance-enhanced exercising dolly is provided when the one or more wheels are positioned downwardly on the floor;

wherein the one or more wheels is a plurality of wheels disposed on a centerline of the second side and enabled to roll along a linear pathway aligned with the centerline;

further comprising a first connector disposed on the centerline;

further comprising a planar ring removably securable to and coplanar with the first planar side to form a part thereof;

wherein the first connector is disposed on a periphery of the planar ring;

further comprising an elongate elastic strap having a proximal end and a distal end and being removably affixable to the first connector at the proximal end;

further comprising a remote fixed-position connector attachable to a stationary surface, and wherein the elongate elastic strap is removably affixable to the remote fixed-position connector at the distal end, wherein a biased and balance-enhanced exercising dolly is provided when the one or more wheels are positioned downwardly on the floor and the strap is connected between the first connector and the remote fixed-position connector;

further comprising a soft planar pad removably affixable to the first planar side and parallel thereto; and wherein the planar ring comprises a center bar there-across, perpendicular to the centerline of the second side.

11. The exerciser/accessory of claim 10, wherein the planar ring comprises a pair of secondary bars there-across, parallel to and spaced symmetrically about the centerline of the second side.

12. The exerciser/accessory of claim 11, wherein the center bar and secondary bars provide handles for grasping during use as a balance-enhanced exercising dolly.

13. The exerciser/accessory of claim 12, wherein the center bar and secondary bars define recesses for foot placement during use as a balance-enhanced exercising dolly.

14. The exerciser/accessory of claim 13, wherein the remote fixed connecter comprises a pair of coplanar, oppositely-directed, and outwardly-directed hooks, symmetrically disposed about a distally projecting longitudinal threaded portion.

15. An accessory for use with an exerciser and comprising:

a baseplate having first and second planar sides and a peripheral edge;

the first planar side removably securable to and coplanar with a circular ring of the exerciser and including a fulcrum disposed centrally thereon and projecting outwardly normally therefrom, and the second planar side being parallel to the first planar side and comprising one or more wheels depending outwardly therefrom;

wherein all of the one or more wheels are colinearly-disposed on a centerline of the second side in order to roll along a single linear pathway aligned with the centerline; and a foot-receiving surface on and coplanar with the second side, disposed symmetrically about the fulcrum.

16. The accessory of claim 15, wherein a balanced-enhanced exercising platform is provided when the fulcrum is positioned downwardly on a floor, and alternatively, a biased and balance-enhanced exercising dolly is provided when the one or more wheels are positioned downwardly on the floor.

17. The accessory of claim 16, wherein the one or more wheels is a plurality of wheels disposed on a centerline of the second side and enabled to roll along a linear pathway aligned with the centerline.

18. The accessory of claim 17, further comprising a soft planar pad removably affixable to the first planar side and parallel thereto.

* * * * *